United States Patent [19]

Atkins et al.

[11] 4,208,358

[45] Jun. 17, 1980

[54] CARBURETOR AND METHOD OF CALIBRATION

[75] Inventors: Terrance J. Atkins; James D. Cronin; Robert L. Hogeman, all of Rochester, N.Y.

[73] Assignee: General Motors Corporation, Detroit, Mich.

[21] Appl. No.: 921,164

[22] Filed: Jul. 3, 1978

Related U.S. Application Data

[63] Continuation-in-part of Ser. No. 868,712, Jan. 11, 1978, abandoned, which is a continuation-in-part of Ser. No. 801,061, May 27, 1977, abandoned.

[51] Int. Cl.[2] ..... F02M 7/18

[52] U.S. Cl. ..... 261/50 R; 123/119 EC; 251/30; 261/121 B; 261/DIG. 74; 137/595

[58] Field of Search ..... 261/121 B, 39 A, DIG. 74, 261/50 R; 123/119 EC, 32 EE, 32 EA, 32 EH; 251/30, 129; 137/595

[56] References Cited

U.S. PATENT DOCUMENTS

| | | | |
|---|---|---|---|
| 1,197,571 | 9/1916 | Bessom | 261/121 B |
| 2,220,558 | 11/1940 | Van Dijck et al. | 123/198 |
| 2,369,698 | 2/1945 | Willenborg | 123/119 |
| 2,747,561 | 5/1956 | Dietrich | 123/119 |
| 2,791,995 | 5/1957 | Dietrich | 123/119 |
| 3,469,590 | 9/1969 | Barker | 137/1 |
| 3,633,869 | 1/1972 | Lehmann | 251/129 |
| 3,667,739 | 6/1972 | Menke | 261/DIG. 38 |
| 3,703,888 | 11/1972 | Eckert et al. | 261/50 A |
| 3,706,444 | 9/1970 | Masaki et al. | 261/39 D |
| 3,827,237 | 9/1972 | Linder et al. | 123/32 EA |
| 3,852,383 | 8/1974 | Seaman | 261/69 R |
| 3,855,974 | 12/1974 | Mayer | 123/119 EC |
| 3,859,397 | 1/1975 | Tryon | 261/121 B |
| 3,874,171 | 4/1975 | Schmidt et al. | 123/32 EA |
| 3,906,910 | 9/1975 | Szlaga, Jr. | 261/121 B |
| 3,933,951 | 1/1976 | Fischer et al. | 261/69 R |
| 3,936,516 | 2/1976 | Nakagawa et al. | 261/39 A |
| 3,994,998 | 11/1976 | Mineck | 261/50 A |
| 4,046,165 | 9/1977 | Rose, Sr. et al. | 137/624.27 |
| 4,132,199 | 1/1979 | Kuroiwa et al. | 261/121 B |

FOREIGN PATENT DOCUMENTS

| | | | |
|---|---|---|---|
| 2559079 | 9/1976 | Fed. Rep. of Germany | 261/121 B |
| 2715014 | 4/1977 | Fed. Rep. of Germany | 123/119 EA |

OTHER PUBLICATIONS

1976 Oldsmobile Chassis Service Manual, Apr. 1976, General Motors Corp., pp. 6M-35 thru 6M-57.

"General Motors", Automotive Engineering, Oct. 1977, p. 38.

SAE paper 770,352, FIG. 4, sketches TQ and YF/YFA, 2-28-77.

S.A.E. paper 780,204, "Development of the Nissan Electronically Controlled Carburetor System", 2-78.

Rochester Products Bulletin, 9D-5, 11-65.

*Primary Examiner*—Tim R. Miles

*Attorney, Agent, or Firm*—C. K. Veenstra

[57] ABSTRACT

A carburetor main metering rod is operated by a bracket carried on a vacuum motor or a solenoid armature to control fuel flow through a main fuel passage, and a bleed valve floats on and is operated by the bracket to control air flow to and thus fuel flow through an idle fuel passage. A gage measures the relative position of the bleed valve within an air bleed body to permit proper calibration of the carburetor.

4 Claims, 9 Drawing Figures

CARBURETOR AND METHOD OF CALIBRATION

This is a continuation-in-part of application Ser. No. 868,712 filed Jan. 11, 1978 and now abandoned which was a continuation-in-part of application Ser. No. 801,061 filed May 27, 1977 and now abandoned.

This invention relates to a carburetor particularly suitable for operation in a closed loop fuel control system and to a method of calibrating such a carburetor.

Several carburetors have been proposed for the purpose of creating an air-fuel mixture of substantially constant (usually stoichiometric) air-fuel ratio for an internal combustion engine. In general, it has been contemplated that such a carburetor would be used in a closed loop system having a sensor—such as a sensor that measures the oxygen content of the engine exhaust gases as an indication of the air-fuel ratio of the mixture created by the carburetor—which would initiate a feedback signal causing the carburetor to create a mixture of the desired air-fuel ratio.

Certain carburetors proposed for that application had a main metering valve operated to create a part throttle mixture of the desired air-fuel ratio but had no idle metering apparatus which could be operated to create an idle mixture of the desired air-fuel ratio. Other carburetors proposed for that application had an idle bleed valve operated to create an idle mixture of the desired air-fuel ratio, but the idle bleed valve had an actuator separate from the actuator for the main metering apparatus and thus involved potentially high cost, complexity, response time and space requirements.

This invention provides a carburetor which, in the preferred embodiments, has a main metering rod operated by a bracket carried either by a solenoid armature or by a vacuum motor to create the desired part throttle mixture and also has an idle bleed valve that floats on and is operated by the same bracket to create the desired idle mixture. The main metering rod and idle bleed valve thus are operated by a common actuator, and yet the fuel metering orifice controlled by the metering rod need not be precisely aligned with the air bleed metering area controlled by the bleed valve. This invention accordingly provides a carburetor of minimized complexity, cost, response time and space requirements as well as a carburetor which may be readily calibrated. In addition, this invention provides a method of calibrating such a carburetor.

The details as well as other features and advantages of this invention are set forth in the following description of several embodiments and are shown in the drawings in which.

Figure 8:
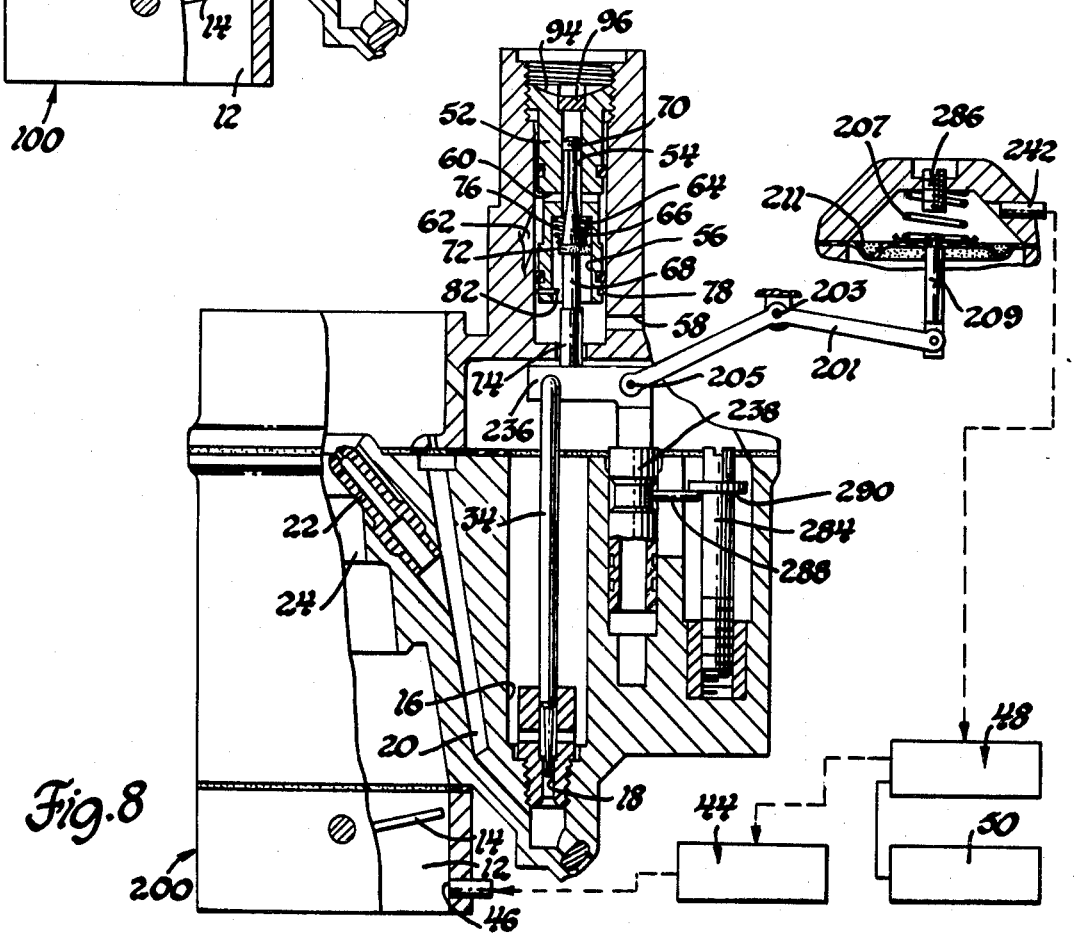
Figure 9:
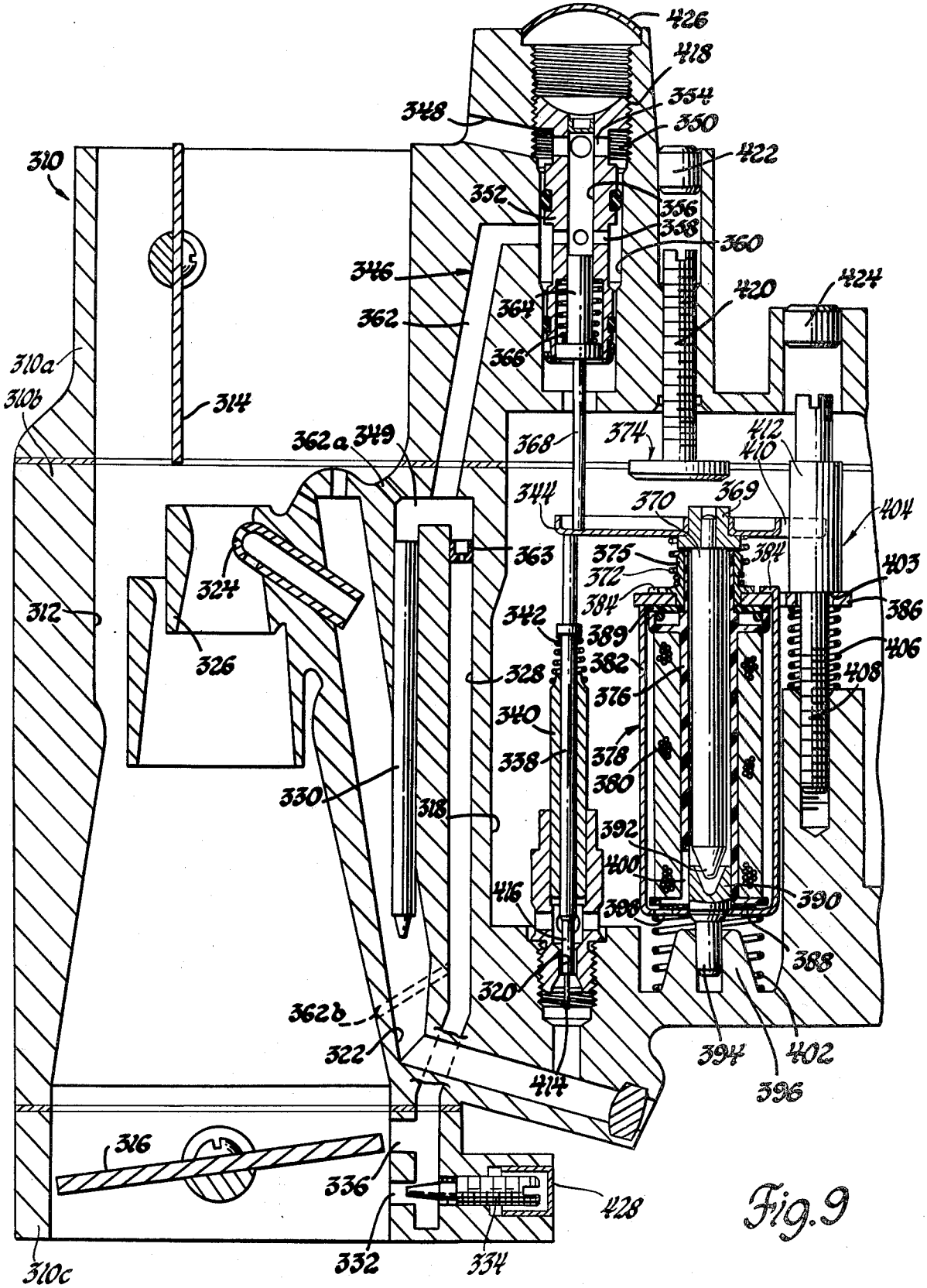

FIG. 8 is a schematic sectional view of a similar carburetor in which the metering rod and bleed valve are operated by a diaphragm vacuum motor; and FIG. 9 is a schematic view of an embodiment of this invention containing the improvements set forth in application Ser. No. 916,783 filed June 19, 1978 in the names of R. L. Hogeman, J. L. Seaman and R. S. Taylor.

Figure 1:
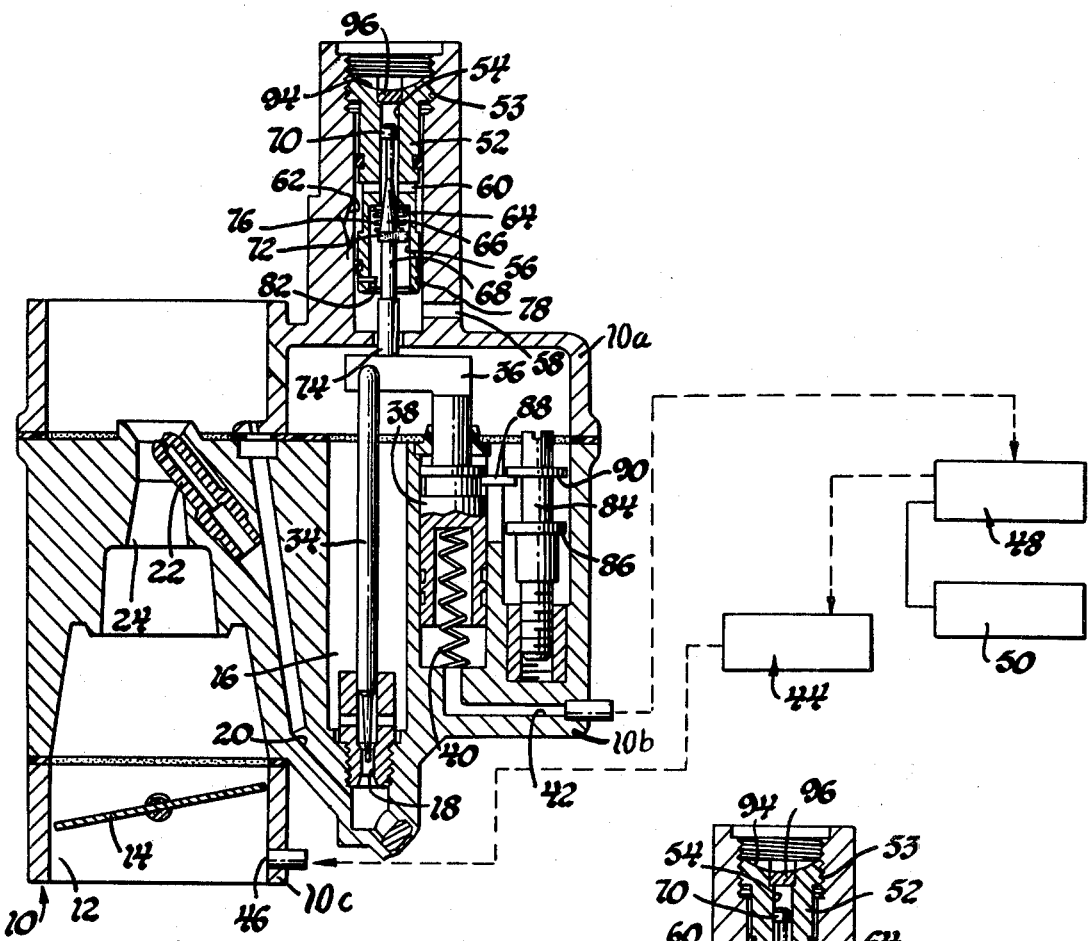
FIG. 1 is a schematic view of the main metering system of a carburetor employing this invention.
Figure 2:
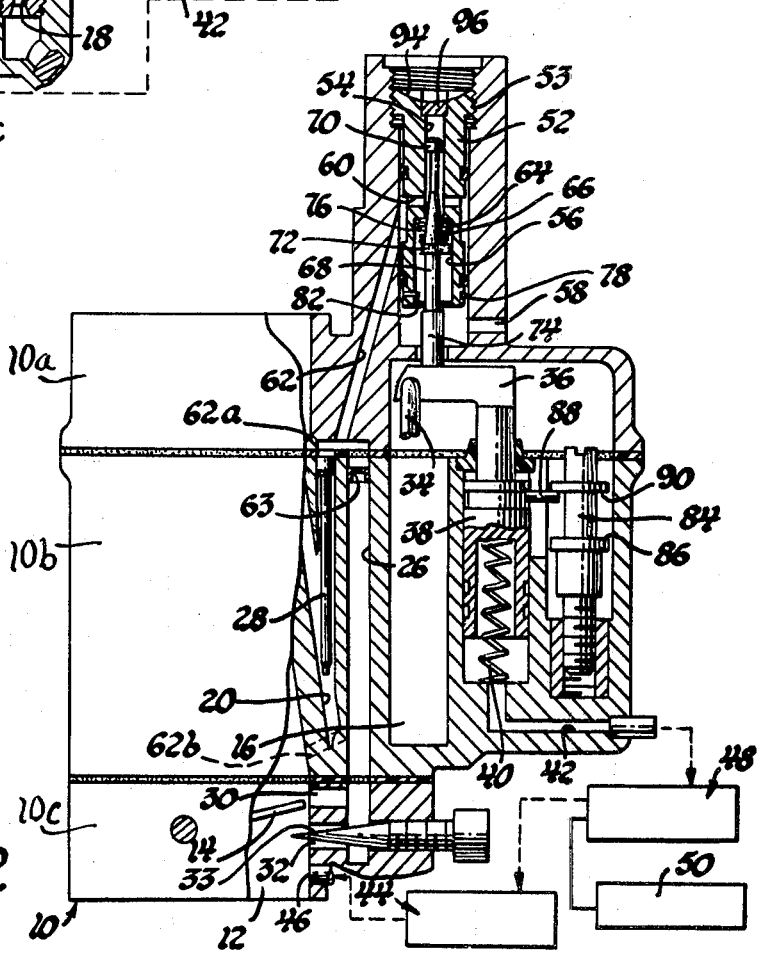
FIG. 2 is a schematic view of the idle system of the FIG. 1 carburetor.

Referring first to FIGS. 1 and 2, an internal combustion engine carburetor 10 has an air horn section **10*a*, a fuel bowl section 10*b* and a throttle body section 10*c* which define an air induction passage 12 controlled by a throttle 14. Within fuel bowl section 10*b*, a fuel bowl 16 delivers fuel through a main metering orifice 18 into a main fuel passage 20 which discharges through a nozzle 22 into a venturi cluster 24 disposed in induction passage 12**.

As shown in FIG. 2, an idle fuel passage 26 has a pickup tube 28 extending into main fuel passage 20, an off-idle port 30 opening into induction passage 12 adjacent throttle 14, and an idle discharge port 32 opening into induction passage 12 past a threaded adjustable mixture needle 33.

A tapered main metering rod 34 is disposed in orifice 18 and is suspended from a horizontally disposed bracket 36 carried by a piston 38. A spring 40 biases piston 38, bracket 36 and metering rod 34 upwardly toward a rich position to permit increased fuel flow through main metering orifice 18 and main fuel passage 20. Piston 38, bracket 36 and metering rod 34 are drawn downwardly toward a lean position by a control vacuum signal applied through a passage 42 to restrict fuel flow through main metering orifice 18 and main fuel passage 20.

A vacuum regulator 44 senses the manifold vacuum at a port 46 in induction passage 12 downstream of throttle 14 and provides a regulated vacuum signal to a solenoid valve 48. Solenoid valve 48 is energized by an electronic package 50 to control the vacuum signal applied through passage 42 to piston 38.

Figure 3:
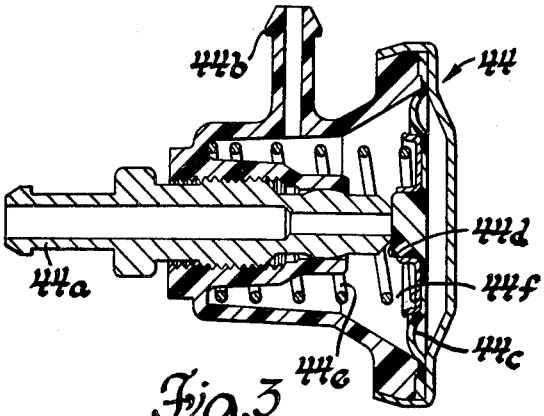
FIG. 3 is a sectional view of a regulator which creates a regulated vacuum signal.

As shown in FIG. 3, regulator 44 has a fitting **44*a* for sensing the manifold vacuum at port 46 and a fitting 44*b* for delivering a regulated vacuum signal to solenoid valve 48. A diaphragm 44*c* carrying a valve member 44*d* is biased rightwardly by a spring 44*e* to permit application of manifold vacuum to a chamber 44*f*. When the vacuum in chamber 44*f* reaches a selected value, diaphragm 44*c* moves leftwardly against the bias of spring 44*e* and valve 44*d* engages the end of fitting 44*a* to preclude further application of vacuum to chamber 44*f*. Should the vacuum in chamber 44*f* drop below the selected value, spring 44*e* will displace diaphragm 44*c* and valve 44*d* rightwardly to expose chamber 44*f* to manifold vacuum. It will be noted that fitting 44*a* is threaded to permit adjustment of the regulated vacuum maintained by regulator 44**.

Figure 4:
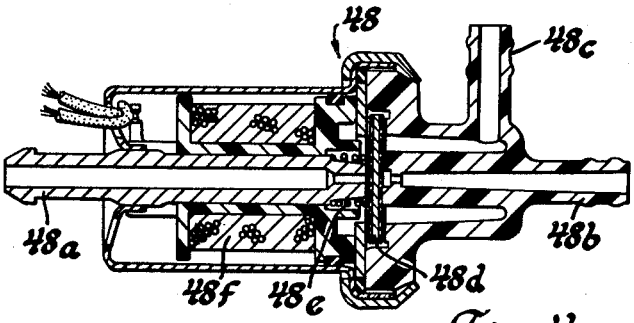
FIG. 4 is a sectional view of a solenoid valve which receives the regulated vacuum signal and provides a control vacuum signal to the FIG. 1 carburetor.
Figure 6:
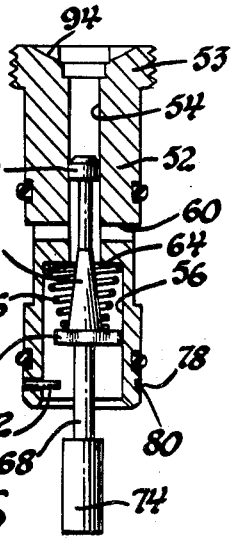
FIG. 6 is a greatly enlarged view of the air bleed body and the bleed valve.

As shown in FIG. 4, solenoid valve 48 includes a fitting **48*a* for receiving the regulated vacuum signal from regulator 44, a fitting 48*b* for receiving clean air at substantially atmospheric pressure, and a fitting 48*c* for delivering a control vacuum signal through passage 42 to piston 38. Solenoid valve 48 is similar to that shown in U.S. Pat. No. 4,005,733 and thus is described only briefly here. Solenoid valve 48 has a disc valve member 48*d* which is biased by a spring 48*e* to engage across air inlet fitting 48b and which is displaced against the bias of spring 48e to engage across regulated vacuum fitting 48a upon energization of a solenoid coil 48f. When solenoid coil 48f is energized, disc valve element 48d allows air flow from fitting 48b to fitting 48c to decrease the control vacuum signal applied to piston 38 and allow spring 40 to move piston 38, bracket 36 and metering rod 34 toward the rich position. When solenoid coil 48f is deenergized, spring 48e moves disc valve element 48d to apply the regulated vacuum signal from fitting 48a through fitting 48c to increase the control vacuum signal applied to piston 38 and move piston 38, bracket 36 and metering rod 34** toward the lean position.

It is contemplated that electronic package 50 will energize coil 48f according to a duty cycle determined by a sensor measuring the air-fuel ratio of the mixture created by carburetor 10—such as a sensor measuring the oxygen content of the engine exhaust gases—and accordingly will seat disc valve member 48d across regulated vacuum fitting 48a or allow disc valve member 48d to seat across air inlet fitting 48b for periods of time which create a control vacuum signal tending to maintain the mixture created by carburetor 10 at a stoichiometric air-fuel ratio or any other desired air-fuel ratio.

As shown in FIGS. 1, 2, 5 and 6, an air bleed body 52 has a flange 53 threaded into air horn section 10a above bracket 36 and has small and large bores 54 and 56 aligned with bracket 36. Large bore 56 is exposed through a vent 58 to a source of air at substantially atmospheric pressure, while a cross drilling 60 connects with small bore 54 and forms part of an air bleed passage 62 which opens into idle fuel passage 26 along with a side idle air bleed 62a upstream of an idle channel restrictor 63 and a lower idle air bleed 62b downstream of restrictor 63.

The opening of small bore 54 from large bore 56 defines a metering area 64 controlled by the taper 66 of an idle bleed valve 68. Bleed valve 68 has a nose 70 guided in small bore 54 and a flange 72 guided in large bore 56; flange 72 has a generally triangular configuration to permit air flow therepast.

The tail 74 of bleed valve 68 floats on the top of bracket 36 and is biased to engage and follow bracket 36 by a light spring 76. A clip 78 is disposed in a groove 80 about the bottom of air bleed body 52 and has a projection 82 extending into large bore 56 to retain bleed valve 68 during assembly. If desired, a slider (not shown) may surround tail 74 to inhibit passage of fluid from fuel bowl 16 about tail 74.

An adjusting screw 84 is disposed adjacent piston 38 and has a lower shoulder 86 forming a lean stop which is engaged by a pin 88 carried by piston 38 to limit movement of the metering apparatus (metering rod 34, bracket 36, piston 38 and bleed valve 68) in the lean direction and an upper shoulder 90 forming a rich stop which is engaged by pin 88 to limit movement of the metering apparatus in the rich direction.

In operation, when the mixture created by carburetor 10 contains excess fuel, electronic package 50 decreases the energizing duty cycle of solenoid valve 48, causing an increase in the control vacuum signal applied through passage 42 to piston 38; piston 38 and bracket 36 then are drawn downwardly toward lean stop 86, causing metering rod 34 to restrict fuel flow through main metering orifice 18 and main fuel passage 20 and allowing spring 76 to lower bleed valve 68 permitting increased air flow through metering area 64 and air bleed passage 62 to idle fuel passage 26 and thereby restricting fuel flow through idle fuel passage 26. When the mixture contains insufficient fuel, electronic package 50 increases the duty cycle of solenoid valve 48, causing a reduction in the control vacuum signal applied through passage 42 to piston 38; spring 40 then lifts piston 38 and bracket 36, thereby lifting metering rod 34 to permit increased fuel flow through main metering orifice 18 and main fuel passage 20 and lifting bleed valve 68 to restrict air flow through metering area 64 and air bleed passage 62 to idle fuel passage 26 and thereby permit increased fuel flow through idle fuel passage 26.

It will be appreciated that during wide open throttle operation when manifold vacuum drops and the pressure at port 46 approaches atmospheric pressure, vacuum regulator 44 and piston spring 40 may be calibrated in such a manner that the available vacuum would be insufficient to retract piston 38 away from rich stop 90 even if electronic package 50 were to demand that solenoid valve 48 apply full manifold vacuum through passage 42 to piston 38.

Figure 5:
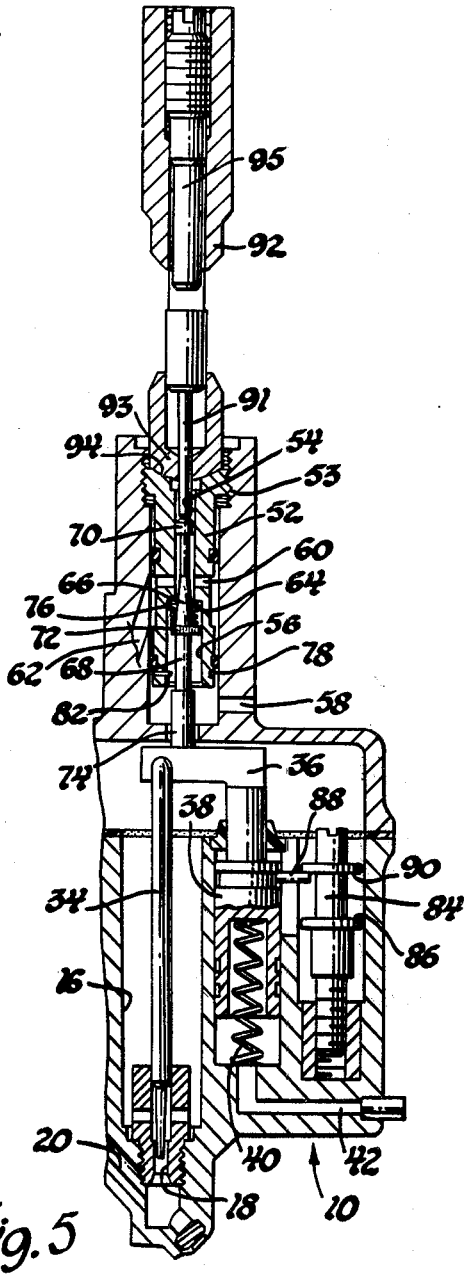
FIG. 5 is a view of a portion of the FIG. 1 carburetor showing a gage for adjusting the air bleed body relative to the bleed valve.

Referring to FIG. 5, carburetor 10 is calibrated by moving air bleed body 52 outwardly as far as practical by turning it on its threaded flange 53, displacing mixture needle 33 a selected number of turns from port 32, engaging piston pin 88 with lean stop 86, adjusting the position of screw 84 to establish the proper position of metering rod 34 in main metering orifice 18 and thus set the lean authority for part throttle operation, and adjusting the position of mixture needle 33 in port 32 to set the lean authority for curb idle operation. Piston pin 88 is then brought into engagement with rich stop 90, a gage pin 91 is inserted in small bore 54 to engage the nose 70 of bleed valve 68, and a gage housing 92 is brought into engagement with the end of air bleed body 52. The tip 93 of gage housing 92 fits in a slot 94 on the end of air bleed body 52. Gage housing 92 is then rotated to turn air bleed body 52, thus raising or lowering air bleed body 52 until scribe marks on gage housing 92 indicate that metering area 64 is properly positioned relative to bleed valve 68.

A retainer 95 in the upper portion of gage housing 92 prevents withdrawal of pin 91 from housing 92.

After adjustment of air bleed body 52 within carburetor 10, small bore 54 is closed with a plug 96 as shown in FIGS. 1 and 2.

Figure 7:
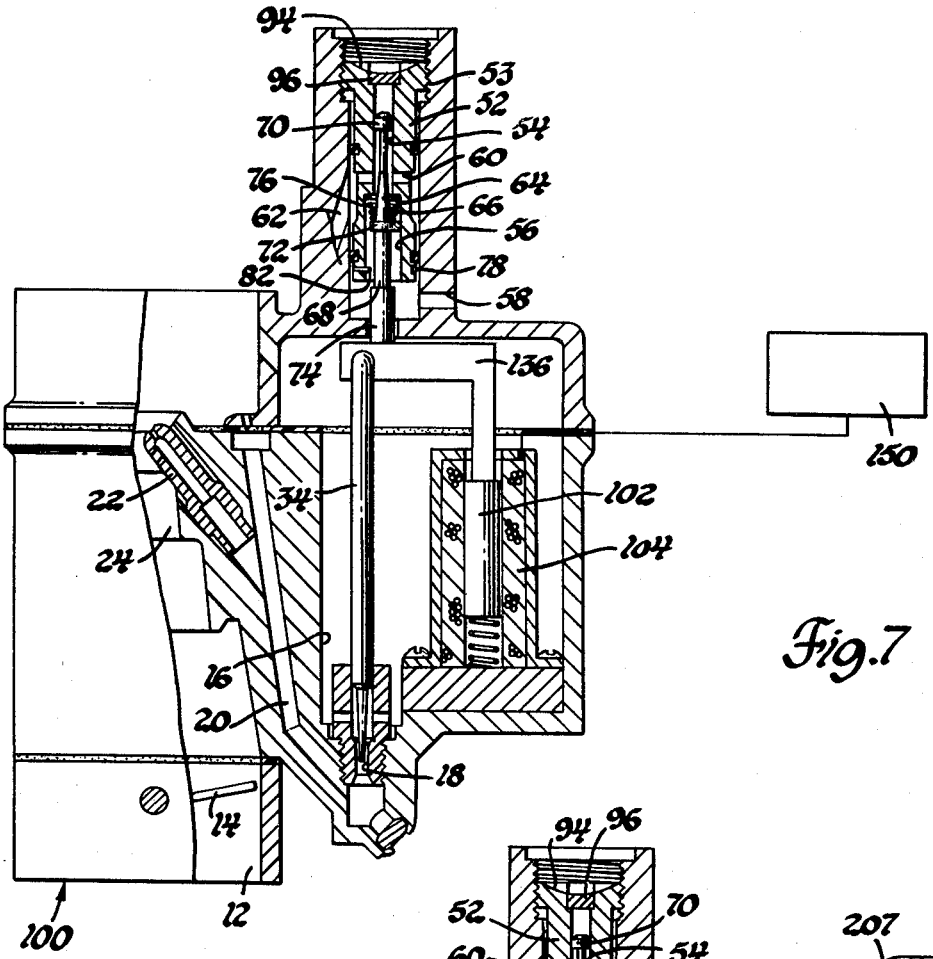
FIG. 7 is a schematic sectional view of a similar carburetor in which the metering rod and bleed valve are operated by a solenoid armature.

FIG. 7 shows an alternative embodiment 100 which is similar in most respects to carburetor 10, and identical parts are designated with the same numerals. In carburetor 100, however, bracket 136 is operated by the armature 102 of a solenoid coil 104 which is energized by an electronic package 150.

FIG. 8 shows yet another embodiment 200 which is similar in many respects to carburetor 10, and identical parts are also designated with the same numerals. In this embodiment, however, the piston 238 guides the bracket 236 but does not impart motion thereto. Instead, a link 201 is mounted on a pivot 203 and has a pivotal connection 205 with bracket 236. Bracket 236 is biased in the rich direction by a spring 207 which acts on link 201 through a stem 209 and is drawn in the lean direction by a diaphragm 211 which acts through stem 209 and link 201 in response to a control vacuum signal received through a vacuum passage 242 from solenoid valve 48. A threaded stop 286 limits movement of diaphragm 211, stem 209, link 201, and bracket 236 in the lean direction, while a shoulder 290 on an adjusting screw 284 is engaged by a pin 288 carried by piston 238 to limit movement of bracket 236 in the rich direction.

In the embodiments of both FIG. 7 and FIG. 8, the tail 74 of bleed valve 68 floats on the bracket 136 or 236, and bleed valve 68 is operated simultaneously with metering rod 34.

FIG. 9 shows an improved embodiment in which the carburetor 310 has an air horn section 310*a*, a fuel bowl section 310*b* and a throttle body section 310*c* which define an air induction passage 312 controlled by a choke 314 and a throttle 316. Within fuel bowl section 310*b*, a fuel bowl 318 delivers fuel through a main metering orifice 320 into a main fuel passage 322 which discharges through a nozzle 324 into a venturi cluster 326 disposed in induction passage 312.

An idle fuel passage 328 has a pick-up tube 330 extending into main fuel passage 322, an idle discharge port 332 opening into induction passage 312 past a threaded adjustable mixture needle 334, and an off-idle port 336 opening into induction passage 312 adjacent throttle 316.

A non-magnetic stainless steel stepped main metering rod 338 is supported in orifice 320 by a non-magnetic stainless steel guide 340 and is biased upwardly by a spring 342 to engage a horizontally disposed stainless steel bracket 344.

In air horn section 310*a*, an idle air bleed passage 346 extends from an inlet 348 to the upper portion 349 of idle fuel passage 328 and includes an annulus 350 about a non-magnetic stainless steel air bleed body 352, upper ports 354, an axial bore 356 and lower ports 358 in air bleed body 352, a second annulus 360 about air bleed body 352, and a lower section 362 opening into idle fuel passage 328 along with a side idle air bleed 362*a* upstream of an idle channel restrictor 363 and a lower idle air bleed 362*b* downstream of restrictor 363. A non-magnetic stainless steel idle bleed valve 364 is disposed in bore 356 to traverse the metering area defined by the opening of lower ports 358 from bore 356 and is biased by a spring 366 so that its tail 368 floats on bracket 344.

Bracket 344 is pressed onto and carried by a non-magnetic stainless steel tip 369 which is pressed onto and forms a part of a nickel plated steel solenoid armature 370. Bracket 344 and armature 370 are biased upwardly by a stainless steel spring 372 to engage tip 369 with the head of a rich stop 374. Spring 372 is retained in an annular recess on a steel sleeve 375.

Armature 370 is received in and guided by a spool 376, molded from 30% glass filled nylon and forming a portion of a solenoid coil assembly 378. A coil 380 is wound on spool 376 and is surrounded by a cupped steel case 382. The upper end of case 382 has three tangs 384 which are bent over a steel end plate 386 into which sleeve 375 is pressed. A domed stainless steel spring washer 388 is disposed between the lower end of spool 376 and the lower end of case 382 to bias spool 376 upwardly toward end plate 386, compressing an insulation washer 389 therebetween.

Solenoid coil assembly 378 has a steel end member 390, pressed into and staked to case 382, which forms a conical air gap with the lower end 392 of armature 370. End member 390 has a projection 394 extending through case 382 and guided in a boss 396 to locate coil assembly 378 within fuel bowl 318.

All steel parts of solenoid coil assembly 378 are zinc dichromated for immersion in fuel bowl 318, and it will be noted that case 382 has a hole 398 and spool 376 has an aperture 400 which permit fuel to circulate within spool 376 about armature 370. Proper operation has been achieved when a fuel filter (not shown) is provided at the carburetor inlet to screen out particles larger than 0.075 mm and the diametral working clearance between spool 376 and armature 370 is between 0.20 and 0.43 mm.

A spring 402 biases solenoid coil assembly 378 upwardly so that end plate 386 engages the shoulder 403 of a lean stop 404. A spring 406 surrounds the threaded stem 408 of lean stop 404 to inhibit changes in the setting of lean stop 404 due to vibration.

Bracket 344 is bifurcated at 410 to surround an extended shank 412 on lean stop 404. Shank 412 thus prevents rotation of armature 370 and bracket 344.

In operation, the metering apparatus (metering rod 338, bracket 344, armature 370 and bleed valve 364) is biased upwardly by springs 342 and 372 to the rich position determined by engagement of armature tip 369 with rich stop 374. In the rich position, the reduced tip 414 of metering rod 338 is disposed in metering orifice 320 to permit increased fuel flow from fuel bowl 318 through metering orifice 320, main fuel passage 322 and nozzle 324 to induction passage 312, while bleed valve 364 obstructs ports 358 to inhibit air flow through bleed passage 346 and thus permit increased fuel flow through idle fuel passage 328 to induction passage 312. When solenoid coil 380 is energized, the metering apparatus is moved to the lean position shown in the drawing, determined by engagement of armature tip 369 with sleeve 375 and established by adjustment of lean stop 404. In the lean position illustrated, the enlarged step 416 of metering rod 338 is disposed in metering orifice 320 to restrict fuel flow from fuel bowl 318 through metering orifice 320, main fuel passage 322 and nozzle 324 to induction passage 312, while bleed valve 364 exposes ports 358 to allow increased air flow through bleed passage 346 into idle fuel passage 328 and thus restrict fuel flow through idle fuel passage 328 to induction passage 312.

It is contemplated that coil 380 will be energized according to a duty cycle of about 10 Hz having a pulse width determined by a sensor measuring the air-fuel ratio of the mixture created by carburetor 310—such as a sensor measuring the oxygen content of the engine exhaust gases—and accordingly will engage armature tip 369 against sleeve 375 for a selected portion of the duty cycle and allow spring 372 to engage armature tip 369 with rich stop 374 for the remainder of the duty cycle; carburetor 310 thus will pulse width modulate the fuel flow and then average high and low fuel flows to create a mixture having a stoichiometric air-fuel ratio or any other desired air-fuel ratio.

Carburetor 10 is calibrated according to the following procedure:

(1) Mixture needle 334, air bleed body 352, rich stop 374 and lean stop 404 are preset to an average setting.

(2) Coil 380 is continuously energized (100% duty cycle), throttle 316 is opened to a part throttle position providing an air flow of, for example, six pounds of air per minute, and lean stop 404 is turned on its threaded stem 408 to establish the lean position of the metering apparatus and thus set the lean part throttle authority for carburetor 310.

(3) Coil 380 is continuously energized (100% duty cycle), throttle 316 is closed to the curb idle position shown in the drawing, and mixture needle 334 is adjusted in port 332 to set the lean idle authority for carburetor 310.

(4) Coil 380 is deenergized (0% duty cycle), throttle 316 is opened to a part throttle position, and rich stop 374 is turned on its threaded stem 420 to establish the rich position for the metering apparatus and thus set the rich part throttle authority for carburetor 310.

(5) Coil 380 is deenergized (0% duty cycle), throttle 316 is closed to the curb idle position, and air bleed body 352 is turned on its threaded shank 418 to adjust the position of body 352 relative to bleed valve 364 and thus set the rich idle authority for carburetor 310.

(6) One or more of the foregoing steps is repeated, other flow points are checked, and plugs 422, 424, 426 and 428 are installed to seal access to adjustable rich and lean stops 374 and 404, air bleed body 352 and mixture needle 334.

Thereafter the carburetor metering apparatus will meter fuel flow between the rich authority and the lean authority when coil 380 is operated at any duty cycle pulse width between 0% and 100%.

It will be appreciated that this invention may be embodied in a two barrel carburetor by addition of another induction passage, main fuel passage, main metering orifice and rod, metering rod guide, idle fuel passage, mixture needle, and lower idle air bleed section; duplication of the bracket, solenoid, air bleed body and valve, and rich and lean stops is not required. Moreover, this invention may be embodied in a multiple stage carburetor by addition of one or more secondary stage induction passages and associated systems of conventional construction.

The embodiments of the invention in which an exclusive property or privilege is claimed are defined as follows:

1. A carburetor comprising a fuel bowl section including main and idle fuel passages, a metering orifice in said main fuel passage, a metering apparatus vertically reciprocable between a rich position and a lean position, said apparatus including a bracket and a metering element operated by said bracket to restrict fuel flow through said orifice in said lean position and to permit increased fuel flow through said orifice in said rich position, an air horn section including an air bleed having a metering area above said bracket and opening into said idle fuel passage, said metering apparatus further including a bleed valve operated by said bracket to restrict air flow through said area and thereby permit increased fuel flow through said idle fuel passage in said rich position and to permit increased air flow through said area and thereby restrict fuel flow through said idle fuel passage in said lean position, said bleed valve having a tail which floats on and is biased into engagement with said bracket for operating said bleed valve whereby said metering orifice in said fuel bowl section need not be precisely aligned with said metering area in said air horn section to allow a common actuating member to operate both said metering element and said bleed valve, and said apparatus also including an actuating member for moving said apparatus between said rich position and said lean position to thereby effect control of fuel flow through both said main fuel passage and said idle fuel passage.

2. A carburetor comprising a fuel bowl section including main and idle fuel passages, a metering orifice in said main fuel passage, a metering apparatus vertically reciprocable between a rich position and a lean position, said apparatus including a bracket and a metering element operated by said bracket to restrict fuel flow through said orifice in said lean position and to permit increased fuel flow through said orifice in said rich position, an air horn section including an air bleed having a metering area above said bracket and opening into said idle fuel passage, said metering apparatus further including a bleed valve operated by said bracket to restrict air flow through said area and thereby permit increased fuel flow through said idle fuel passage in said rich position and to permit increased air flow through said area and thereby restrict fuel flow through said idle fuel passage in said lean position, said bleed valve having a tail which floats on and is biased into engagement with said bracket for operating said bleed valve whereby said metering orifice in said fuel bowl section need not be precisely aligned with said air bleed body in said air horn section to allow a common actuating member to operate both said metering element and said bleed valve, and said metering apparatus also including an actuating member for moving said apparatus between said rich position and said lean position to thereby effect control of fuel flow through both said main fuel passage and said idle fuel passage, and wherein an air bleed body defines said area, said body including means for adjusting the position of said area relative to said bleed valve to thereby establish the proper air flow through said bleed and thus the proper fuel flow through said idle fuel passage.

3. The method of calibrating a carburetor which includes main and idle fuel passages, a metering orifice in said main fuel passage, an air bleed body forming a portion of an air bleed opening into said idle fuel passage and defining a metering area in said bleed, a metering apparatus movable in rich and lean directions and including a metering rod controlling fuel flow through said orifice and a bleed valve controlling air flow through said bleed, and stop means for limiting movement of said apparatus, said method comprising the steps of:

engaging said apparatus with said stop means and adjusting said stop means to establish the proper position of said metering rod relative to said orifice, and thereafter engaging said apparatus with said stop means, engaging a gage pin with said valve, engaging a gage housing with said body, and adjusting the position of said body relative to said valve until the relative positions of said pin and said housing indicate that said area is properly positioned relative to said valve.

4. The method of calibrating a carburetor which includes main and idle fuel passages, a metering orifice in said main fuel passage, an air bleed body forming a portion of an air bleed opening into said idle fuel passage and defining a metering area in said bleed, a metering apparatus movable in rich and lean directions and including a metering rod controlling fuel flow through said orifice and a bleed valve controlling air flow through said bleed, and rich and lean stop means for limiting movement of said apparatus in said rich and lean directions respectively, said method comprising the steps of:

engaging said apparatus with said stop means and adjusting the position of said stop means to establish the proper position of said metering rod relative to said orifice, and thereafter engaging said apparatus with said rich stop means, engaging a gage pin with said valve, engaging a gage housing with said body, and adjusting the position of said body relative to said valve until the relative positions of said pin and said housing indicate that said area is properly positioned relative to said valve.

* * * * *